US008409327B2

(12) United States Patent
Taylor et al.

(10) Patent No.: US 8,409,327 B2
(45) Date of Patent: Apr. 2, 2013

(54) CONTROL OF GROUNDED SURFACE GEOMETRY IN ELECTROSTATICALLY ENHANCED FABRIC FILTERS

(75) Inventors: Robert Taylor, Ponte Vedra Beach, FL (US); Karim Younsi, Ballston Lake, NY (US); David F. Johnston, Poquoson, VA (US); Yingneng Zhou, Niskayuna, NY (US); Yaru Najem Mendez Hernandez, Bavaria (DE); Prabhakar Neti, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 375 days.

(21) Appl. No.: 12/793,942

(22) Filed: Jun. 4, 2010

(65) Prior Publication Data

US 2011/0296989 A1 Dec. 8, 2011

(51) Int. Cl.
*B03C 3/155* (2006.01)

(52) U.S. Cl. ..... 95/57; 55/341.1; 55/DIG. 5; 96/66

(58) Field of Classification Search ..... 96/59, 66, 96/83; 95/57, 78; 55/341.1, 360, DIG. 5
See application file for complete search history.

(56) References Cited

U.S. PATENT DOCUMENTS

| | | | | |
|---|---|---|---|---|
| 3,577,705 | A * | 5/1971 | Sharlit | 95/2 |
| 3,839,185 | A * | 10/1974 | Vicard | 204/665 |
| 3,910,779 | A | 10/1975 | Penney | |
| 5,217,511 | A | 6/1993 | Plaks et al. | |
| 5,938,818 | A * | 8/1999 | Miller | 95/63 |
| 6,152,988 | A | 11/2000 | Plaks et al. | |
| 6,544,317 | B2 * | 4/2003 | Miller | 95/63 |
| 6,932,857 | B1 * | 8/2005 | Krigmont | 95/63 |
| 7,341,616 | B2 * | 3/2008 | Taylor et al. | 95/70 |
| 2006/0201117 | A1 * | 9/2006 | Regnier | 55/341.1 |

FOREIGN PATENT DOCUMENTS

| | | | | |
|---|---|---|---|---|
| CN | 101274305 | A | 1/2008 | |
| GB | 2177321 | A * | 1/1987 | 55/341.1 |
| GB | 2462516 | A | 2/2010 | |
| WO | 99/10103 | A1 | 3/1999 | |

OTHER PUBLICATIONS

Great Britain Search Report dated Aug. 31, 2011.

* cited by examiner

*Primary Examiner* — Richard L Chiesa
(74) *Attorney, Agent, or Firm* — Cooper Legal Group, LLC

(57) ABSTRACT

An electrostatic filter assembly configured to be installed in equipment for removing particulate matter entrained within a gas stream. The filter assembly functions in the removal and collection of the particulate matter from the gas stream. The equipment for removing particulate matter includes a high voltage discharge electrode for imparting an electric charge to the particulate matter whereby an electrical field is produced at the filter assembly. The filter assembly includes a filter element and a supporting structure for the filter element. The supporting structure is configured to establish at the filter assembly, under the operating conditions of the equipment for removing particulate matter, an electrical field having an intensity that produces no more than a selected amount of degradation at the filter element during operation of the equipment for removing particulate matter. Also a method of manufacturing such an electrostatic filter assembly.

18 Claims, 2 Drawing Sheets

CONTROL OF GROUNDED SURFACE GEOMETRY IN ELECTROSTATICALLY ENHANCED FABRIC FILTERS

BACKGROUND OF THE INVENTION

1. Field of the Invention

The present invention relates generally to gas-cleaning equipment and in particular to equipment for removing particulate matter entrained within a gas stream, wherein an electrostatically enhanced filter assembly for removing the particulate matter from the gas stream is employed.

2. Discussion of the Prior Art

A type of gas-cleaning equipment for removing particulate matter entrained within a gas stream that is in wide-spread use is the so-called electrostatic precipitator. An electrostatic precipitator typically includes high voltage discharge electrodes that ionize the gas stream as it passes by the electrodes and impart an electric charge to, i.e., ionize, the particulate matter entrained in the gas stream. Typically the charged or ionized particulate matter flows to electrically grounded stacks of large flat metal plates at which the particulate matter is removed from the gas stream and at least temporarily collected. The gas stream from which the particulate matter has been removed is then exhausted from the gas-cleaning equipment. Various types of mechanical means, such as "rappers", for example, that intermittently strike the collector plates and dislodge the particulate matter collected at the plates, can be provided for removing the collected particulate matter. In many designs, the dislodged particulate matter slides or falls downwardly to hoppers where the particulate matter is accumulated for disposal.

A type of electrostatic precipitator that also is employed, and under many circumstances can more efficiently remove the particulate matter entrained in the gas stream, is an electrostatic precipitator that employs filter assemblies, rather than large flat metal plates, for removing and collecting the particulate matter. In this type of precipitator, each filter assembly typically includes a filter element and a supporting structure for the filter element. The filter assembly is electrically grounded, and the particulate matter which has been electrically charged, as by high voltage discharge electrodes, flows to the filter assembly where the particulate matter is removed from the gas stream and collected. Because this type of an electrostatic precipitator is designed so that the gas stream can only be exhausted from the precipitator after passing through the filter element, an enhanced degree of particulate matter removal can take place at the filter element because the gas stream with the entrained particulate matter must first pass through the filter element, where the particulate matter is removed and at least temporarily collected, before the gas stream is exhausted from the precipitator. Various means known to those having ordinary skill in the art can be utilized for dislodging the particulate matter that collects at the filter assemblies. Typically, the particulate matter, as it is dislodged, falls into bins or hoppers where the particulate matter accumulates until it is removed.

It can be the case with electrostatic precipitators that employ filter assemblies for removing and collecting the particulate matter from a gas stream that electrical fields are created at the filter assemblies by the high voltage discharge electrodes that are used to impart an electrical charge to the particulate matter. These electrical fields can be detrimental to the filter elements of the filter assemblies under the operating conditions to which the electrostatic precipitators are subjected. This is particularly the case where a fabric filter element is used. Oftentimes, the fabric filter element will develop holes through which the gas stream with entrained particulate matter can flow and be exhausted from the precipitator. Thus, the ability of the fabric filter to remove the particulate matter from the gas stream can be compromised in those instances.

BRIEF SUMMARY OF THE INVENTION

The following sets forth a simplified summary of the invention for the purpose of providing a basic understanding of examples of selected aspects of the invention. The summary does not constitute an extensive overview of all the aspects or embodiments of the invention. Moreover, the summary is not intended to identify critical aspects or delineate the scope of the invention. The sole purpose of the summary is to present selected concepts of the invention in a simplified form as an introduction to the more detailed description of the invention that follows the summary.

In accordance with one aspect, the present invention provides an electrostatically enhanced filter assembly that is configured to be installed in equipment for removing particulate matter entrained within a gas stream. The filter assembly functions to remove and collect the particulate matter from the gas stream. The equipment for removing particulate matter also includes a high voltage discharge electrode for imparting an electric charge to the particulate matter whereby an electrical field is produced at the filter assembly. The filter assembly includes a filter element and a supporting structure for the filter element. The supporting structure is configured to establish at the filter assembly, under the operating conditions of the equipment for removing particulate matter, an electrical field having an intensity that produces no more than a selected amount of degradation to the filter element during operation of the equipment for removing particulate matter.

In accordance with another aspect, the present invention provides a method of manufacturing an electrostatically enhanced filter assembly configured to be installed in equipment for removing particulate matter entrained within a gas stream, wherein the filter assembly functions in the removal and collection of particulate matter from the gas stream. The filter assembly includes a filter element and a supporting structure for the filter element, and the equipment for removing particulate matter includes a high voltage discharge electrode for imparting an electric charge to the particulate matter whereby an electrical field is produced at the filter assembly. The method includes providing the supporting structure for the filter element such that the electrical field produced at the filter assembly under the operating conditions of the equipment for removing particulate matter is of an intensity no greater than the intensity of the electrical field that produces a selected amount of degradation at the filter element and assembling the filter element and the supporting structure so designed. In accordance with another aspect, the present invention provides an electrostatically enhanced filter assembly produced by this method.

BRIEF DESCRIPTION OF THE DRAWINGS

The foregoing and other aspects of the present invention will be apparent to those skilled in the art to which the present invention relates from the detailed descriptions of examples of embodiments of the invention that follow with reference to the accompanying drawings, wherein the same reference numerals are used in the several figures to refer to the same parts or elements, and in which.

DETAILED DESCRIPTION OF THE INVENTION

Examples of embodiments that incorporate one or more aspects of the present invention are described below with reference to the accompanying drawings. These illustrated examples are not intended to be limitations on the present invention. Thus, for example, one or more aspects of the present invention described with reference to one embodiment can be utilized in other embodiments. In addition, certain terminology is used herein for convenience only and is not to be taken as limiting the present invention.

Figure 2:
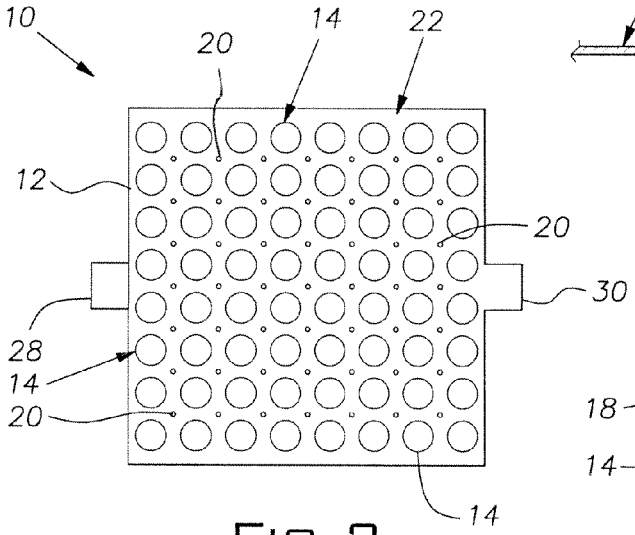
FIG. 2 is a schematic top view, partly in section, of the gas-cleaning equipment of FIG. 1.
Figure 3:
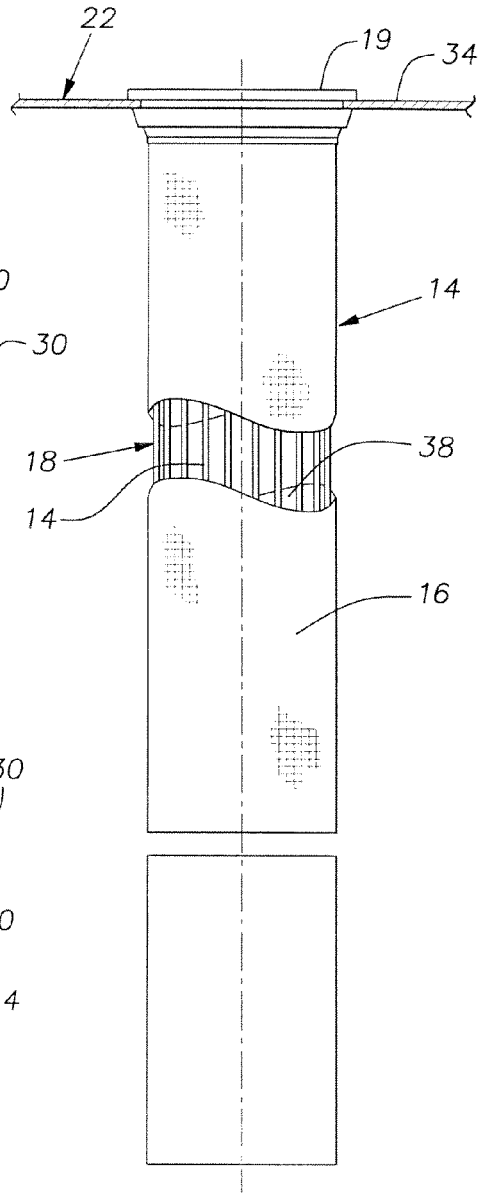
FIG. 3 is a schematic elevational view, partly in section, of one example of an embodiment of a filter assembly according to the present invention.
Figure 1:
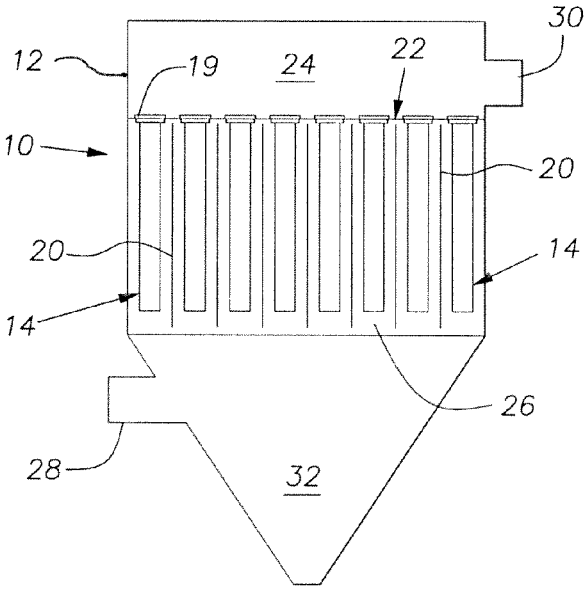
FIG. 1 is a schematic elevational view, partly in section, of gas-cleaning equipment in which a plurality of an example of an embodiment of a filter assembly according to the present invention are incorporated.

A type of gas-cleaning equipment employing electrostatic forces and filtering means for removing and collecting particulate matter entrained within a gas stream, wherein embodiments of the electrostatically enhanced filter assemblies of the present invention can be advantageously utilized, is shown generally at 10 in FIGS. 1 and 2. The gas-cleaning equipment includes a housing 12 that contains a plurality of the electrostatically enhanced filter assemblies, each of which is identified generally by the reference numeral 14, that are positioned in substantially parallel rows and columns throughout the entirety of the interior of the housing 12 as is best seen in FIG. 2. As shown in FIG. 3, each filter assembly 14 includes a filter element 16 and a supporting structure, shown generally at 18, for the filter element. Each filter assembly is suitably suspended substantially downwardly at a respective opening in a sheet 22, such as a metal plate for example, that extends across the entirety of the interior of the housing 12 and separates the housing into a first section 24 and a second section 26 in which the filter assemblies 14 are located. The openings in the sheet 22 at which the filter assemblies are suspended provide for the interiors 38 of the filter assemblies to be in fluid communication with the first section 24. A collar or flange 19 attached to each filter assembly 14 is shown in FIGS. 1 and 3 as the means by which the filter assembly is suspended from the sheet 22, although other means that will be obvious to one of ordinary skill in the art can be used for that purpose. Each filter assembly is electrically grounded in a manner familiar to those having ordinary skill in the art. In addition, the filter assemblies can be anchored in place by attachments, not shown, between the bottoms of the filter assemblies and means secured to the interior of the housing 12.

The gas-cleaning equipment also includes a plurality of high voltage discharge electrodes, each of which is identified by the reference numeral 20 in FIGS. 1 and 2. The electrodes are arranged substantially vertically within the second section 26 of the housing 12 and extend substantially over the entire vertical dimension of the second section 26 such that the electrodes are at least substantially the same length as the filter assemblies 14. The electrodes are shown in FIGS. 1 and 2 to be located substantially equidistant among four adjacent filter assemblies and are electrically insulated from their surroundings, including the filter assemblies, in a manner that is familiar to those having ordinary skill in the art. An alternative electrode arrangement provides for an electrode to be located within and substantially coaxially with the central axis of each filter assembly 14.

The housing 12 also includes an inlet 28 that is in fluid communication with the second section 26 of the housing 12 containing the filter assemblies 14 and through which the gas stream with entrained particulate matter enters the gas-cleaning equipment. Also included in the housing 12 is an outlet 30 that is in fluid communication with the first section 24 of the housing 12 and through which the gas stream after it has been cleaned of the particulate matter by at the filter assemblies 14 is exhausted to the exterior of the housing 12. An accumulation bin 32 for collecting particulate matter removed from the gas stream, and which can be configured so as to have sloping walls, whereby the removal of the accumulated particulate matter from the housing 12 is facilitated, is included in the housing below the second section 26 of the housing. In this regard, some of the particulate matter removed at the filter assemblies 14 will fall of their own accord to the bins 32 but most of the particulate matter will adhere to the filter assemblies and have to be dislodged. Various means known to those having ordinary skill in the art can be employed for dislodging the particulate matter which will then fall to the bin 32 where the particulate matter accumulates until removed at an access opening at the bottom of the bin.

An example of an embodiment of an electrostatically enhanced filter assembly 14 configured to be installed in equipment for removing particulate matter entrained within a gas stream, such as the equipment illustrated in FIGS. 1 and 2, wherein the filter assembly functions in the removal and collection of the particulate matter from the gas stream, is shown in detail in FIG. 3. As indicated above, the filter assembly 14 includes a filter element 16 and a supporting structure 18 for the filter element. The filter assembly, which typically is suitably electrically grounded to the housing 12 in a manner, not shown, that is familiar to those having ordinary skill in the art, is illustrated in the embodiment of FIG. 3 to be suspended at the sheet 22 by a collar or flange 19 that is attached to the filter assembly 14 and rests at the upper surface 34 of the sheet 22. The filter element 16 itself, in the embodiment of FIG. 3, includes a fabric filter element, i.e., a filter element made of a suitable fabric, which includes an elongated substantially annular structure such that the elongated dimension of the filter element extends substantially the entire distance between the first section 24 and the second section 26 of the housing 12. Because of the annular configuration of the fabric filter element 16, and the manner in which the fabric filter element is suspended at the sheet 22, the interior 38 of the filter assembly 14 is open to or in fluid communication with the first section 24 of the housing 12.

Although shown to be substantially circular in cross-section in the embodiment of FIG. 3, the fabric filter element can have other cross-sections such as rectangular, square or elliptical cross-sections for example. In addition, as will be familiar to those having ordinary skill in the art, a wide variety of fabrics can be employed in the fabric filter elements. For example, the fabrics may be woven or include felts and can be made from natural materials such as cotton or synthetic materials such as polyesters and acrylics. Also the fabrics can include what is referred to in the art as "membranes". Additionally, the filter element can be made of materials other than a fabric as may be suitably selected for performing the function of filtering particulate matter entrained in a gas stream.

Figure 4:
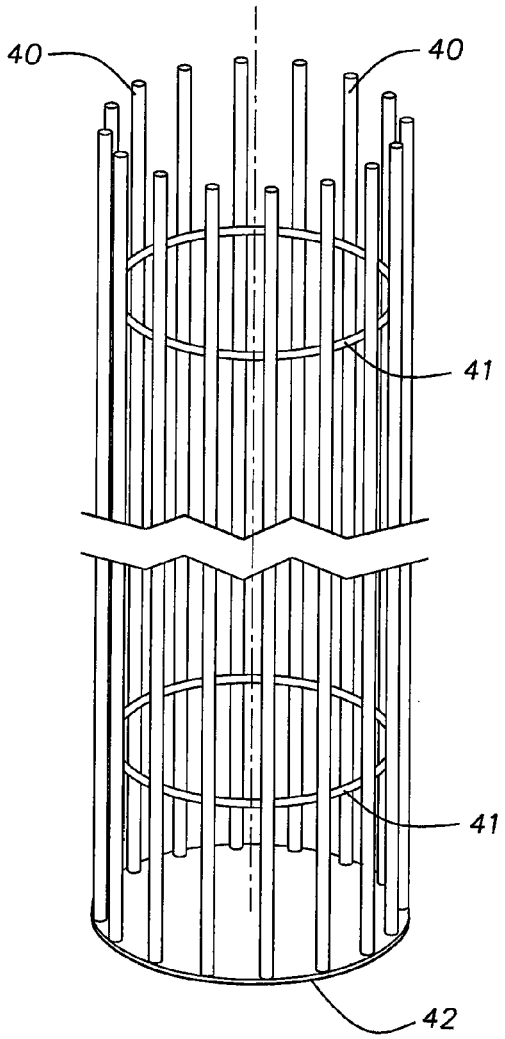
FIG. 4 is a schematic perspective view of an example of an embodiment of a supporting structure for a filter assembly according to the present invention.

The supporting structure 18 in the embodiment of FIG. 3, as shown in greater detail in FIG. 4, includes a plurality of spaced-apart rods, each of which is identified by the reference numeral 40. The rods have a radius of curvature and are positioned in a circular pattern in a manner such that the rods are arranged (1) within, and substantially concentrically with respect to, the elongated substantially annular selected fabric filter element 16 and (2) substantially parallel to the elongated dimension of the selected fabric filter element. The rods 40 are held in place by one or more ring-like elements 41 that are suitably attached to the rods at spaced locations along the lengths of the rods. A closure plate 42 is attached to the ends of the bottoms of the rods. The filter element 16 is secured to the supporting structure 18 at the closure plate 42 and at selected locations along the entire lengths of the rods 40 of the supporting structure. The filter element 16 completely encloses the supporting structure 18 so that the gas stream with entraned particulate matter cannot enter the interior 38 of the filter assembly except by passing through the filter element 16.

In operation, the gas-cleaning equipment, including the filter assemblies 14, functions as follows. The air inlet 28 is in air-flow communication with a source of a gas stream, not shown, in which is entrained particulate matter. For example, the source of the gas stream can include a coal-burning installation or a process vessel such as a steel-making vessel. The gas stream with entrained particulate matter under the influence of air-moving equipment such as fans, not shown, is caused to flow into the housing 12 through the air inlet 28 from which location the gas stream passes into the second section 26 of the housing 12 and into the region where the filter assemblies 14 and the high voltage discharge electrodes 20 are located. The particulate matter entrained in the gas stream as it passes through the electrical fields created by the electrodes 20 is charged or ionized. Thereafter, the charged particulate matter moves to the filter assemblies 14 at which the particulate matter is removed from the gas stream and collected as the gas stream passes through the filter elements 16. The cleaned gas from which the particulate matter has been removed after passing through the filter elements 16 moves upwardly of the interiors 38 of the filter assemblies, through the open top ends of the filter assemblies and into the first section 24 of the housing 12. From there, the cleaned gas is exhausted to the exterior of the housing through the gas outlet 30.

It is the case that the discharge electrodes 20, in imparting an electric charge to the particulate matter, also create an electrical field at the filter assemblies 14. This electrical field can result in the filter elements being degraded. The degradation can be in the form of degradation of the filter elements that reduces their filtering capabilities and can lead to their total destruction.

The present invention controls the degradation to the filter elements 16 that can occur as a result of the creation of the electrical fields at the filter assemblies. The control is accomplished by configuring the supporting structures 18 so as to establish at each filter assembly, under the operating conditions of the equipment for removing particulate matter, an electrical field having an intensity that produces no more than a selected approximate maximum amount of degradation at the selected filter element during the operation of the equipment for removing particulate matter. In other words, there are a large number of variables that influence the design parameters that are relevant to the operation of gas-cleaning equipment of the type that has been described. One of these design parameters concerns an approximate maximum amount of degradation to a filter element of a selected type that is acceptable or is otherwise selected for that filter element. For example, it can be the case that for a filter element of a selected type, a greater approximate maximum amount of degradation to the filter element is acceptable or is selected in connection with the cleaning of a gas stream containing one type of particulate matter than is acceptable or selected in connection with the cleaning of a gas stream containing another type of particulate matter. Ideally, it would be the case that no degradation results to the selected filter element. However, the design and operating parameters that are relevant to the efficient operation of the gas-cleaning equipment and are required to be implemented can result in the filter assemblies experiencing degradation. The present invention allows for the efficient operation of the gas-cleaning equipment while controlling the amount of degradation that is experienced at the filter elements.

In the embodiment of the invention illustrated in FIG. 3, wherein the selected filter element 16 includes a fabric filter element having an elongated substantially annular structure, the selected approximate maximum amount of degradation to the selected filter element can include a selected approximate maximum number of pin holes in the fabric filter element. These pin holes can be produced by electric stresses created at the filter element as a result of the interaction between the supporting structures 18 and the electrical fields at the filter assemblies created by the discharge electrodes 20. Pin holes in the fabric filter can compromise the particulate matter removal efficiency of the filter element because the pin holes allow some of the gas stream with the entrained particulate matter to pass through the fabric filter element 16 without any of the particulate matter being removed. As a result, the entrained particulate matter will pass upwardly internally of the filter assembly 14 into the first section 24 of the housing 12 and be exhausted from the gas cleaning equipment through the outlet 30. The present invention controls the frequency of occurrence of such pin holes by providing supporting structures that are configured to establish at the filter assembly an electrical field having an intensity that produces no more than a selected approximate maximum number of pin holes in the selected fabric filter element under the operating conditions of the equipment for removing particulate matter.

It has been found that in the case of filter elements of the type shown in and described with respect to FIG. 3, where the supporting structure includes a plurality of rods having a radius of curvature and arranged within, and substantially parallel to the elongated dimension of the selected fabric filter element, the radius of curvature of the rods influences the number of pin holes that will be created in the selected fabric filter element. Specifically, it has been found that under like circumstances, the incidence of pin hole formation decreases as the radius of curvature of the rods increases. Consequently, in accordance with one embodiment of the invention, the radius of curvature of the rods is such as to generate an electrical field at the selected fabric filter element having an intensity less than the intensity of the electrical field required to cause a selected approximate maximum number of pin holes at the selected fabric filter element.

Figure 5:
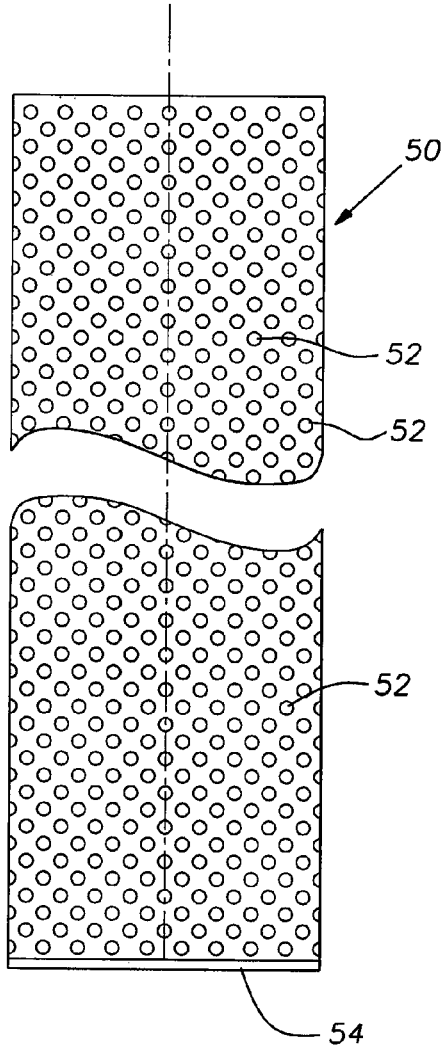
FIG. 5 is a schematic elevational view of another example of an embodiment of a supporting structure for a filter assembly according to the present invention.

In the embodiment of the invention shown in FIG. 5, the supporting structure 50 for the elongated substantially annular selected fabric filter element 16 includes a substantially hollow cylinder that is located within, and substantially concentrically with respect to, the selected fabric filter element. The supporting structure 50 also includes a plurality of openings 52. The openings 52 allow gas from the gas stream, after passing through the selected fabric filter element 16, to pass to the interior of the supporting structure from where the gas then passes through the open top of the supporting structure into the first section 24 of the housing 12 of the gas-cleaning equipment. From the first section 24 of the housing 12, the cleaned gas is exhausted through the outlet 30. The supporting structure 50 also includes a closure cap 54 that closes off the bottom of the supporting structure so that gas with entrained particulate matter cannot enter the interior of the supporting structure and cleaned gas cannot flow from the interior of the supporting structure to the second section 26 of the housing 12 of the gas-cleaning equipment 10. A supporting structure including a substantially hollow cylinder as shown in the embodiment of FIG. 4 results under like conditions in the formation of a fewer number of pin holes in selected fabric filter elements than supporting structures made of rods as illustrated in FIG. 3.

The present invention in certain of its embodiments also provides for methods of manufacturing electrostatically enhanced filter assemblies. In one embodiment, a method is provided of manufacturing an electrostatically enhanced filter assembly, such as the filter assembly 14 shown in FIG. 3 for example, configured to be installed in equipment for removing particulate matter entrained within a gas stream such as the gas-cleaning equipment 10 of FIG. 1 for example. As described above, the filter assembly functions in the removal and collection of particulate matter from the gas stream and includes a selected filter element, such as the filter element 16 of FIG. 3 for example, and a supporting structure, such as the supporting structure 18 of FIG. 3 for example. The equipment for removing particulate matter includes a high voltage discharge electrode, such as an electrode 20 of the gas cleaning equipment of FIG. 1 for example, for imparting an electric charge to the particulate matter whereby an electrical field is produced at the filter assembly. The method includes providing the supporting structure for the selected filter element such that the electrical field produced at the filter assembly under the operating conditions of the equipment for removing particulate matter is of an intensity no greater than the intensity of the electrical field that produces a selected approximate maximum amount of degradation at the selected filter element; and assembling the selected filter element and the supporting structure so designed.

The foregoing method can be applied to embodiments in which the selected filter elements include selected fabric filter elements, including selected fabric filter elements having elongated substantially annular structures such as the selected fabric filter element 16 of FIG. 3 for example. And, with respect to these embodiments, the selected approximate maximum amount of degradation at the selected fabric filter element can include a selected approximate maximum number of pin holes in the selected fabric filter element. Thus, degradation and an associated corona activity are selected to have approximate maximums. Embodiments of the supporting structure, such as the supporting structure 18 of FIG. 3 for example, in the method embodiment can include a plurality of rods, such as the rods 40 for example, having a radius of curvature and arranged within, and substantially concentrically with respect to, the elongated substantially annular selected fabric filter element. In that embodiment, the rods can be arranged substantially parallel to the elongated dimension of the selected fabric filter element. Also with respect to the embodiments employing rods, the step of providing the supporting structure for the selected fabric filter element can include providing rods for the supporting structure so as to have a radius of curvature no smaller than the radius of curvature that produces at the filter assembly an electrical field having an intensity that produces the selected approximate maximum number of pinholes in the selected fabric filter element under the operating conditions of the equipment for removing particulate matter. And in another embodiment, the step of providing the supporting structure for the selected filter element can include providing a substantially hollow cylinder such as the supporting structure 50 of FIG. 5 for example, that (a) is located within, and substantially concentrically with respect to, the elongated substantially annular selected fabric filter element and includes a plurality of openings through which gas from the gas stream, after passing through the selected fabric filter element, passes to the interior of the supporting structure and (b) results in the production at the filter assembly under the operating conditions of the equipment for removing particulate matter of an electrical field of an intensity no greater than the intensity of the electrical field that produces the selected approximate maximum number of pin holes in the selected fabric filter element. The present invention also concerns embodiments directed to the electrostatically enhanced filter assemblies produced by the described method embodiments.

The present invention also concerns embodiments that in the methods described in the several preceding paragraphs involve in the providing of the supporting structure the additional steps of selecting the approximate maximum amount of degradation to be produced at the selected filter element by the electrical field produced by the high voltage discharge electrode at the filter assembly under the operating conditions of the equipment for removing particulate matter and determining the intensity of the electrical field produced at the filter assembly that causes the selected approximate maximum amount of degradation to be produced at the selected filter element under the operating conditions of the equipment for removing particulate matter.

The present invention also relates to embodiments concerning the procedure of operating equipment for removing particulate matter entrained within a gas stream, such as the gas-cleaning equipment 10 of FIG. 1 for example, wherein the equipment for removing particulate matter includes (1) at least one electrostatically enhanced filter assembly, such as the filter assembly 14 of FIG. 3 for example, that includes a selected filter element, such as the selected fabric filter element 16 of FIG. 3 for example, and a supporting structure for the selected filter element, such as the supporting structure 18 of FIG. 3 for example, and (2) at least one high voltage discharge electrode, such as a high voltage electrode 20 of the gas-cleaning equipment of FIG. 1 for example, for imparting an electric charge to the particulate matter whereby an electrical field is produced at the at least one filter assembly. According to embodiments of the present invention, this procedure includes the method of controlling the intensity of the electrical field at the at least one filter assembly by providing a supporting structure at the at least one filter assembly having a configuration that produces an electrical field at the at least one filter assembly of a preselected intensity under the operating conditions of the equipment for removing particulate matter. The preselected intensity can be one that is preselected for any reason including for the reason of controlling the amount of degradation that is produced at the selected filter element.

While the present invention has been described above and illustrated with reference to certain embodiments thereof, it is to be understood that the invention is not so limited. Modifications and alterations will occur to those skilled in the art upon reading and understanding the specification, including the drawings. In any event, the present invention covers and includes any and all modifications and variations to the described embodiments that are encompassed by the following claims.

What is claimed is:

1. An electrostatic filter assembly configured to be installed in equipment for removing particulate matter entrained within a gas stream, wherein the filter assembly functions in the removal and collection of the particulate matter from the gas stream, and the equipment for removing particulate matter includes a high voltage discharge electrode for imparting an electric charge to the particulate matter whereby an electrical field is produced at the filter assembly, the filter assembly including;

a filter element; and a supporting structure for the filter element, the supporting structure being configured to establish at the filter assembly, under the operating conditions of the equipment for removing particulate matter, an electrical field having an intensity that produces no more than a selected amount of corona activity and degradation at the filter element during operation of the equipment for removing particulate matter.

2. The electrostatic filter assembly of claim 1 wherein:

the filter element includes a fabric filter element; and the selected amount of degradation at the filter element includes a selected approximate number of pin holes in the fabric filter element.

3. The electrostatic filter assembly of claim 2 wherein:

the fabric filter element includes an elongated substantially annular structure;

the supporting structure includes a plurality of spaced-apart rods having a radius of curvature and arranged within, and substantially concentrically with respect to, the elongated substantially annular fabric filter element and substantially parallel to the elongated dimension of the substantially annular fabric filter element; and the radius of curvature of the rods is such that the electrical field produced at the fabric filter element has an intensity no greater than the intensity of the electrical field that produces the selected approximate maximum number of pin holes in the fabric filter element under the operating conditions of the equipment for removing particulate matter.

4. The electrostatic filter assembly of claim 2 wherein:

the fabric filter element includes an elongated substantially annular structure; and the supporting structure includes a substantially hollow cylinder that is located within, and substantially concentrically with respect to, the elongated substantially annular fabric filter element and includes a plurality of openings through which gas from the gas stream, after passing through the fabric filter element, passes to the interior of the supporting structure.

5. A method of manufacturing an electrostatic filter assembly configured to be installed in equipment for removing particulate matter entrained within a gas stream, wherein the filter assembly functions in the removal and collection of particulate matter from the gas stream and includes a filter element and a supporting structure for the filter element, and the equipment for removing particulate matter includes a high voltage discharge electrode for imparting an electric charge to the particulate matter whereby an electrical field is produced at the filter assembly, the method including:

providing the supporting structure for the filter element such that the electrical field produced at the filter assembly under the operating conditions of the equipment for removing particulate matter is of an intensity no greater than the intensity of the electrical field that produces a selected amount of degradation at the filter element; and assembling the filter element and the supporting structure so designed.

6. An electrostatic filter assembly produced by the method of claim 5.

7. The method of claim 5 wherein:

the filter element includes a fabric filter element; and the selected amount of degradation at the filter element includes a selected number of pin holes in the fabric filter element.

8. An electrostatic filter assembly produced by the method of claim 7.

9. The method of claim 7 wherein:

the fabric filter element includes an elongated substantially annular structure;

the supporting structure includes a plurality of spaced-apart rods having a radius of curvature and arranged within, and substantially concentrically with respect to, the elongated substantially annular fabric filter element and substantially parallel to the elongated dimension of the elongated substantially annular fabric filter element; and the step of providing the supporting structure for the filter element includes providing the rods of the supporting structure to have a radius of curvature no smaller than the radius of curvature that produces at the filter assembly an electrical field having an intensity that produces the selected number of pinholes in the fabric filter element under the operating conditions of the equipment for removing particulate matter.

10. An electrostatic filter assembly produced by the method of claim 9.

11. The method of claim 7 wherein:

the fabric filter element includes an elongated substantially annular structure; and the step of providing the supporting structure for the filter element includes providing a substantially hollow cylinder that (a) is located within, and substantially concentrically with respect to, the elongated substantially annular fabric filter element and includes a plurality of openings through which gas from the gas stream, after passing through the fabric filter element, passes to the interior of the supporting structure and (b) results in the production at the filter assembly under the operating conditions of the equipment for removing particulate matter of an electrical field of an intensity no greater than the intensity of the electrical field that produces the selected number of pin holes in the fabric filter element.

12. An electrostatic filter assembly produced by the method of claim 11.

13. The method of claim 5 including;

selecting the amount of degradation to be produced at the filter element by the electrical field produced by the high voltage discharge electrode at the filter assembly under the operating conditions of the equipment for removing particulate matter; and determining the intensity of the electrical field produced at the filter assembly that causes the selected amount of degradation to be produced at the filter element under the operating conditions of the equipment for removing particulate matter.

14. The method of claim 13 wherein:

the filter element includes a fabric filter element; and the selected amount of degradation at the filter element includes a selected number of pin holes in the fabric filter element.

15. The method of claim 14 wherein:

the fabric filter element includes an elongated substantially annular structure;

the supporting structure includes a plurality of spaced-apart rods having a radius of curvature and arranged within, and substantially concentrically with respect to, the elongated substantially annular fabric filter element and substantially parallel to the elongated dimension of the elongated substantially annular fabric filter element; and the step of providing the supporting structure for the filter element includes providing the rods of the supporting structure to have a radius of curvature no smaller than the radius of curvature that produces at the filter assembly an electrical field having an intensity that produces the selected number of pinholes in the fabric filter element under the operating conditions of the equipment for removing particulate matter.

16. An electrostatic filter assembly produced by the method of claim 15.

17. The method of claim 14 wherein:

the fabric filter element includes an elongated substantially annular structure; and the step of providing the supporting structure for the filter element includes providing a substantially hollow cylinder that (a) is located within and substantially concentrically with respect to the elongated substantially annular fabric filter element and includes a plurality of openings through which gas from the gas stream, after passing through the fabric filter element, passes to the interior of the supporting structure and (b) results in the production at the filter assembly under the operating conditions of the equipment for removing particulate matter of an electrical field of an intensity no greater than the intensity of the electrical field that produces the selected number of pin holes in the fabric filter element.

18. An electrostatic filter assembly produced by the method of claim 17.

* * * * *